US011553774B2

(12) United States Patent
Solomon

(10) Patent No.: US 11,553,774 B2
(45) Date of Patent: Jan. 17, 2023

(54) HAIR REMOVAL APPARATUS

(71) Applicant: BRAND STREET MARKET, LLC, Oldwick, NJ (US)

(72) Inventor: Philip Solomon, Kibbutz Tzora (IL)

(73) Assignee: BRAND STREET MARKET, LLC, Oldwick, NJ (US)

( * ) Notice: Subject to any disclaimer, the term of this patent is extended or adjusted under 35 U.S.C. 154(b) by 387 days.

(21) Appl. No.: 16/628,041

(22) PCT Filed: Jul. 1, 2018

(86) PCT No.: PCT/US2018/040524
§ 371 (c)(1),
(2) Date: Jan. 2, 2020

(87) PCT Pub. No.: WO2019/010103
PCT Pub. Date: Jan. 10, 2019

(65) Prior Publication Data

US 2021/0137240 A1 May 13, 2021

Related U.S. Application Data

(60) Provisional application No. 62/528,111, filed on Jul. 2, 2017.

(51) Int. Cl.
*A45D 26/00* (2006.01)
*B26B 21/48* (2006.01)

(52) U.S. Cl.
CPC ..... *A45D 26/0009* (2013.01); *B26B 21/48* (2013.01)

(58) Field of Classification Search
None
See application file for complete search history.

(56) References Cited

U.S. PATENT DOCUMENTS 2,727,132 A 12/1955 Hills
3,041,726 A 7/1962 Hitson
(Continued)

FOREIGN PATENT DOCUMENTS

CN 1388773 A 1/2003
CN 1545444 A 11/2004
(Continued)

OTHER PUBLICATIONS

International Search Report for PCT/US2018/040524 dated Oct. 17, 2018 by the USPTO.

(Continued)

*Primary Examiner* — Hwei-Siu C Payer
(74) *Attorney, Agent, or Firm* — Webb and Co. Ltd.

(57) ABSTRACT

A hair removal apparatus constituted of: an elongated heating element constituted of a material which generates heat responsive to electric power being applied thereto; and a hair adjustment unit comprising: a first elongated member generally in parallel with the elongated heating element, a second elongated member generally in parallel with the elongated heating element, and a plurality of extension members extending from the second elongated member, away from the first elongated member, the elongated heating element positioned between the first elongated member and the extension members, wherein each extension member exhibits a base end and a tip end, each extension member extending from the second elongated member at the base end towards the tip end, and wherein a first face of each of the plurality of extension members, at the tip ends, and a face of the first elongated member define a plane.

10 Claims, 2 Drawing Sheets

(56) References Cited

U.S. PATENT DOCUMENTS

| | | | | |
|---|---|---|---|---|
| 3,093,724 | A | 6/1963 | Johnson | |
| 6,043,457 | A * | 3/2000 | Hashimoto | A45D 26/0009 132/118 |
| 7,170,034 | B2 * | 1/2007 | Shalev | A45D 26/0009 219/241 |
| 8,389,906 | B2 | 3/2013 | Azar et al. | |
| 2006/0027554 | A1 * | 2/2006 | Hashimoto | A45D 26/0009 219/225 |
| 2007/0145031 | A1 * | 6/2007 | Shalev | A45D 26/0009 30/140 |
| 2014/0114301 | A1 | 4/2014 | Solomon et al. | |
| 2016/0242526 | A1 | 8/2016 | Rafaeli et al. | |
| 2021/0137240 | A1 * | 5/2021 | Solomon | A45D 26/0009 |

FOREIGN PATENT DOCUMENTS

| | | | |
|---|---|---|---|
| CN | 104223727 | A | 12/2014 |
| WO | WO 2014/159413 | A2 * | 10/2014 |

OTHER PUBLICATIONS

Written Opinion of the International Searching Authority for PCT/US2018/040524 dated Oct. 17, 2018 by the USPTO.

* cited by examiner

HAIR REMOVAL APPARATUS

TECHNICAL FIELD

The present invention relates generally to the field of hair removal and more particularly to a heating element based hair removal apparatus with a plurality of extension members.

BACKGROUND

The removal of unwanted hair growth from the body can be accomplished with mechanized means, for example razors, tweezers or wax, all of which are uncomfortable to use, irritate the skin and/or cause damage to the skin. Another form of hair removal is by heating the hair growth to a temperature sufficient to cut the hair. U.S. patent application publication S/N US 2014/0114301, published Apr. 24, 2014 to Solomon et al., the entire contents of which are incorporated herein by reference, is addressed to a heating element based hair removal and re-growth suppression apparatus with a plurality of teeth arranged to facilitate smooth movement of the device across the skin. U.S. patent application publication S/N 2016/0242526, published Aug. 25, 2016 to Rafaeli et al., the entire contents of which are incorporated herein by reference, is addressed to a heating element based hair removal apparatus with a plurality of skin depressors arranged to reduce the distance between the hair to be cut and the heating element. Unfortunately, these devices do not provide an efficient enough method for improving contact of the heating element with the hair strands.

SUMMARY

Accordingly, it is a principal object to overcome at least some of the disadvantages of prior art. This is accomplished in certain embodiments by providing a hair removal apparatus comprising: an elongated heating element constituted of a material which generates heat responsive to electric power being applied thereto; and a hair adjustment unit, wherein the hair adjustment unit comprises: a first elongated member generally in parallel with the elongated heating element, a second elongated member generally in parallel with the elongated heating element, and a plurality of extension members extending from the second elongated member, away from the first elongated member, the elongated heating element positioned between the first elongated member and the plurality of extension members, wherein each of the plurality of extension members exhibits a base end and a tip end, each extension member extending from the second elongated member at the base end towards the tip end, and wherein a first face of each of the plurality of extension members, at the tip ends, and a face of the first elongated member define a plane.

Additional features and advantages will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF THE PREFERRED EMBODIMENTS

Figure 1A:
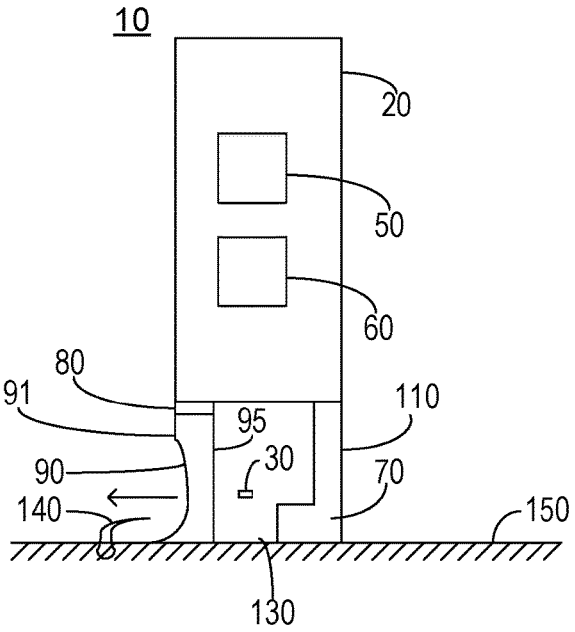
FIGS. 1A-1D illustrates various high level views of a hair removal apparatus, comprising an elongated heating element and a hair adjustment unit, according to certain embodiments.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 1B:
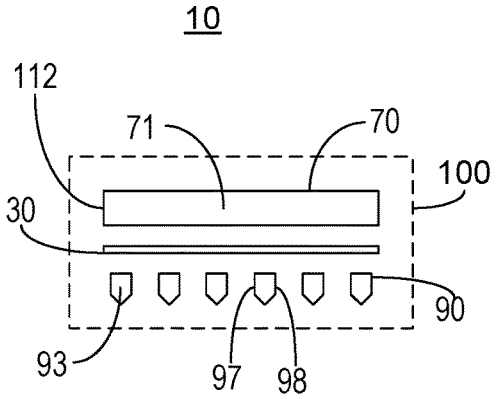
Figure 1C:
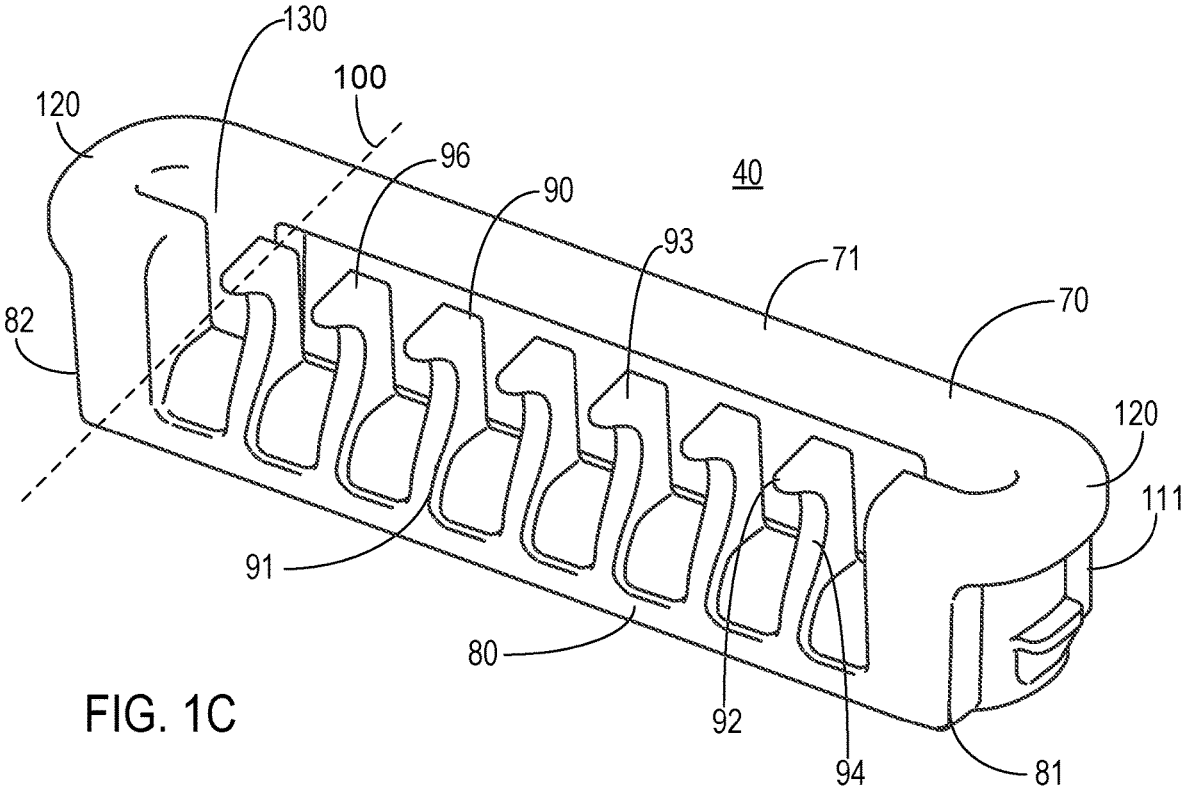
Figure 1D:
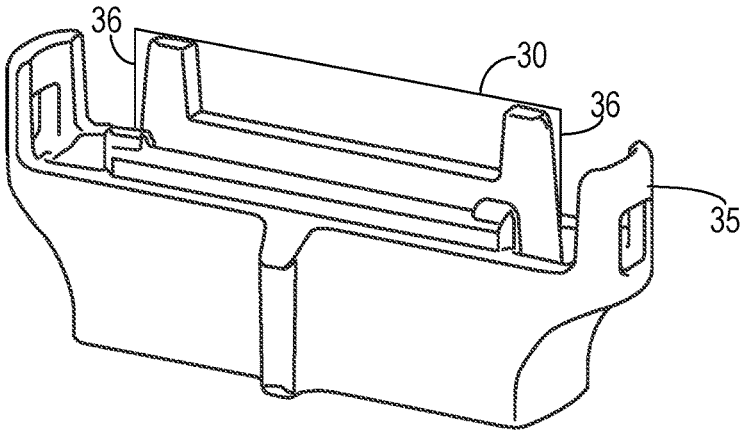

FIG. 1A illustrates a high level schematic cut-away side view of a hair removal apparatus 10, according to certain embodiments. Hair removal apparatus 10 comprises: a user holding device 20; an elongated heating element 30; an optional heating element support unit 35; and a hair adjustment unit 40. FIG. 1B illustrates a high level schematic bottom view of hair removal apparatus 10. FIG. 1C illustrates a high level perspective view of an embodiment of hair adjustment unit 40. FIG. 1D illustrates a high level perspective view of optional heating element support unit 35. FIGS. 1A-1D will be described together. User holding device 20 comprises: a control circuitry 50; and a power terminal 60. Hair adjustment unit 40 comprises: an elongated member 70 exhibiting a face 71; an elongated member 80; and a plurality of extension members 90, each exhibiting a base end 91, a tip end 92, a first face 93 and a second face 94 opposing first face 93. First face 93 of each extension member 90 comprises a first portion 95 and a second portion 96.

Elongated heating element 30 is constituted of a material which generates heat responsive to electric power being applied thereto, i.e. a material which generates heat when electric current flows therethrough responsive to the electrical resistance thereof. In one embodiment, elongated heating element 30 is constituted of a Nickel Chromium alloy. In one further embodiment, elongated heating element 30 is constituted of Nichrome. In another embodiment, elongated heating element 30 is constituted of a Molybdenum disilicide alloy. In another embodiment, elongated heating element 30 is constituted of a ferritic iron-chromium-aluminum alloy.

In one embodiment, elongated heating element 30 is elongate rectangular cuboid shaped. In one further embodiment, elongated heating element 30 presents a rectangular cross-section having a length to width ratio of 2-8, optionally a length to width ratio of about 5. In one embodiment, the width of the cross section of elongated heating element 30 presents a width of 0.06-1 mm, optionally a width of about 0.08 mm.

Power terminal 60 is coupled to an internal or an external power source (not shown). In an embodiment where an internal power source is provided, the internal power source is preferably rechargeable. Elongated heating element 30 is in electrical communication with power terminal 60 (connection not shown) and is arranged to receive power therefrom, responsive to control circuitry 50. Elongated heating element 30 and hair adjustment unit 40 are each secured to user holding device 20. In one embodiment, elongated heating element 30 and hair adjustment unit 40 are separately secured to user holding device 20, i.e. they are each secured to user holding device 20 but not to each other. Advantageously, this allows greater flexibility in choosing the material for hair adjustment unit 40. If elongated heating element 30 was coupled to hair adjustment unit 40, the material used would be limited to materials which don't conduct electricity so as not to cause a short circuit or have electric current travel to the skin surface. In one further embodiment, as illustrated in FIG. 1D, elongated heating element 30 is secured to optional heating element support unit 35, heating element support unit 35 secured to user holding device 20. Optionally, elongated heating element 30 is secured to optional heating element support unit 35, at each end of elongated heating element 30, by a respective connector 36. Each connector 36 is further arranged to supply electric current to elongated heating element 30. In another embodiment, hair adjustment unit 40 is secured to user holding device via heating element support unit 35, i.e. hair adjustment unit 40 is secured to heating element support unit 35 (connection not shown).

Elongated members 70 and 80 are each generally in parallel with elongated heating element 30. Additionally, elongated heating element 30 is positioned between elongated member 70 and elongated member 80. In one non-limiting embodiment, the width of face 71 of elongated member 70 is between 2-3 mm. In another non-limiting embodiment, the length of face 71 is between 20-25 mm. Each extension member 90 extends from elongated member 80, each extension member 90 extending towards tip end 92 thereof in a direction away from elongated member 70. Particularly, each extension member 90 is coupled to elongated member 80 at base end 91 thereof and extends towards tip end 92 thereof, the extension towards tip end 92 being away from elongated member 70. First faces 93 of extension members 90, at the respective tip ends 92, and face 71 of elongated member 70 define a plane 100.

In one embodiment, first face 93 of each extension member 90 is generally L shaped. Particularly, first portion 95 of first face 93 is generally orthogonal to plane 100 and second portion 96 of first face 93 is generally flat and extends within plane 100. First portion 95 and second portion 96 define the general L shape of first face 93. In another embodiment, second face 94 of each extension member 90 is generally concave shaped. In one embodiment, each extension member 90 narrows towards tip end 92 thereof. Specifically, second portion 96 of first face 93 exhibits a first edge 97 and a second edge 98 opposing first edge 97, first edge 97 and second edge 98 culminating in tip end 92. The distance between first edge 97 and second edge 98 decreases as it approaches tip end 92. In one further non-limiting embodiment, the maximum distance between first edge 97 and second edge 98, at the junction of first portion 95 and second portion 96, is between 1-1.5 mm. In another further embodiment, second portion 96 of first face 93 is generally triangularly shaped, with a base of the triangle meeting first portion 95 of first face 93. In one non-limiting embodiment, the distance between adjacent extension members 90, measured at the junction of first portion 95 and second portion 96 of first face 93, is between 1.5-2.5 mm. In another non-limiting embodiment, the sum of the areas of second portions 96 plus the area of face 71 is between 40-80 $mm^2$. In one embodiment, hair adjustment unit 40 is constituted of a material exhibiting a high thermal conductivity, such as a ceramic or metal alloy. In one further non-limiting embodiment, the thermal conductivity of extension members 90, particularly second portions 96 thereof, and the thermal conductivity of elongated member 70, particularly face 71 thereof, is at least 1 Watt/mK.

In one embodiment, elongated members 70 and 80 are coupled to each other on either ends thereof to form a closed structure. Particularly, in one embodiment elongated member 70 extends, orthogonally to face 71, to form a back wall 110 of hair adjustment unit 40. Back wall 110 exhibits a first side 111 and a second side 112 opposing first side 111. Elongated member 80 extends from a first side 81 to a second side 82 thereof. A first side wall 120 extends from first side 111 of back wall 110 to first side 81 of elongated member 80 and a second side wall 120 extends from second side 112 of back wall 110 to second side 82 of elongated member 80. In another embodiment, the width of back wall 110 is narrower than the width of face 71 of elongated member 70.

An opening 130 is defined between elongated member 70 and extension members 90, opening 130 meeting plane 100. Elongated heating element 30 is juxtaposed with opening 130. In one non-limiting embodiment, the width of opening 130, i.e. the distance between elongated member 70 and extension members 90, is between 1.5-2.5 millimeters.

In operation, control circuitry 50 controls power terminal 60 to provide electric power to elongated heating element 30. As described above, responsive to electric power being applied thereto, elongated heating element 30 generates heat. Particularly, elongated heating element generates heat of a sufficient temperature to cut hairs 140 protruding from a skin surface 150. In one embodiment, the temperature of the generated heat is 400°-1900° C., further optionally 1000°-1900° C. In another embodiment, a thermal sensor is provided (not shown) in communication with elongated heating element 30, the output of the thermal sensor provided as a feedback to control circuitry 50. In such an embodiment, control circuitry 50 is arranged to maintain supervisory control of the temperature of elongated heating element 30 and prevent the temperature of elongated heating element 30 from exceeding a predetermined maximum, and optionally further ensures that the temperature of elongated heating element 30 does not fall below a predetermined minimum during operation.

A user applies hair adjustment unit 40 to skin surface 150 such that face 71 of elongated member 70 and second portions 96 of first faces 93 of extension members 90 come in contact with skin surface 150, i.e. plane 100 meets skin surface 150. The user, holding user holding device 20, moves hair adjustment unit 40 across skin surface 150 in the direction of the extension of extension members 90 towards tip ends 92.

As hair adjustment unit 40 is moved across skin surface 150, extension members 90 apply pressure to hairs 140, thereby pushing hairs 140 into upright positions such that each hair is in a generally upright position when it comes into contact with elongated heating element 30. As a result, the chance of elongated heating element 30 successfully cutting the hair 140 significantly increases. Face 71 of elongated member 70 and first faces 93 of extension members 90 provide increased surface area contact with skin surface 150, thereby increasing the amount of heat which is transferred to skin surface 150. As described above, in one embodiment the surface area in contact with skin surface 150 is between 40-80 $mm^2$ and in another embodiment the thermal conductivity of the material in contact with skin surface 150 is at least 1 W/mK. Some of the heat which is radiated from elongated heating element 30 is transferred to skin surface 150 via extension members 90 and elongated member 70. This allows skin surface 150 to act as a heat sink for hair removal apparatus 10, thereby preventing hair removal apparatus 10 from overheating and applying additional heat to the follicles of hairs 140 to prevent future hair growth.

In one embodiment (not shown), a motion sensor, or velocity sensor, is provided, comprising any of a plurality of standard sensors including, but not limited to: an optical sensor; a magnetic sensor; a mechanical sensor; and an ultrasonic sensor. In such an embodiment, control circuitry 50 calculates the rate of relative motion of hair adjustment unit 40 along skin surface 150 responsive to the output of the sensor. Optionally, control circuitry 50 further increases the magnitude of electric power being applied to elongated heating element 30 as a predetermined function of an increase in the determined rate of relative motion and decreases the magnitude of electric power being applied to elongated heating element 30 as a predetermined function of a decrease in the determined rate of relative motion. It is noted that increasing the magnitude of electric power is from a first non-zero value to a second value, greater than the first value. Similarly, decreasing the magnitude of electric power is from a third value to a fourth non-zero value, less than the third value. In one further embodiment, control circuitry is arranged to control power terminal 60 to provide electric power to elongated heating element 30 only in the event that the determined rate of relative motion is greater than a predetermined threshold value.

In another embodiment, a controllable lift mechanism (not shown) is provided. The controllable lift mechanism translates elongated heating element 30 towards and away from opening 130, as described in U.S. patent application publication S/N US 2014/0114301, published Apr. 24, 2014 to Solomon et al. In one embodiment, responsive to the determined rate of relative motion being below the predetermined threshold value, the controllable lift mechanism translates elongated heating element 30 away from opening 130. In another embodiment, the controllable lift mechanism regularly translates elongated heating element 30 between a first position and a second position, at a predetermined frequency, the distance between opening 130 and the first position being greater than the distance between opening 130 and the second position.

Figure 2:
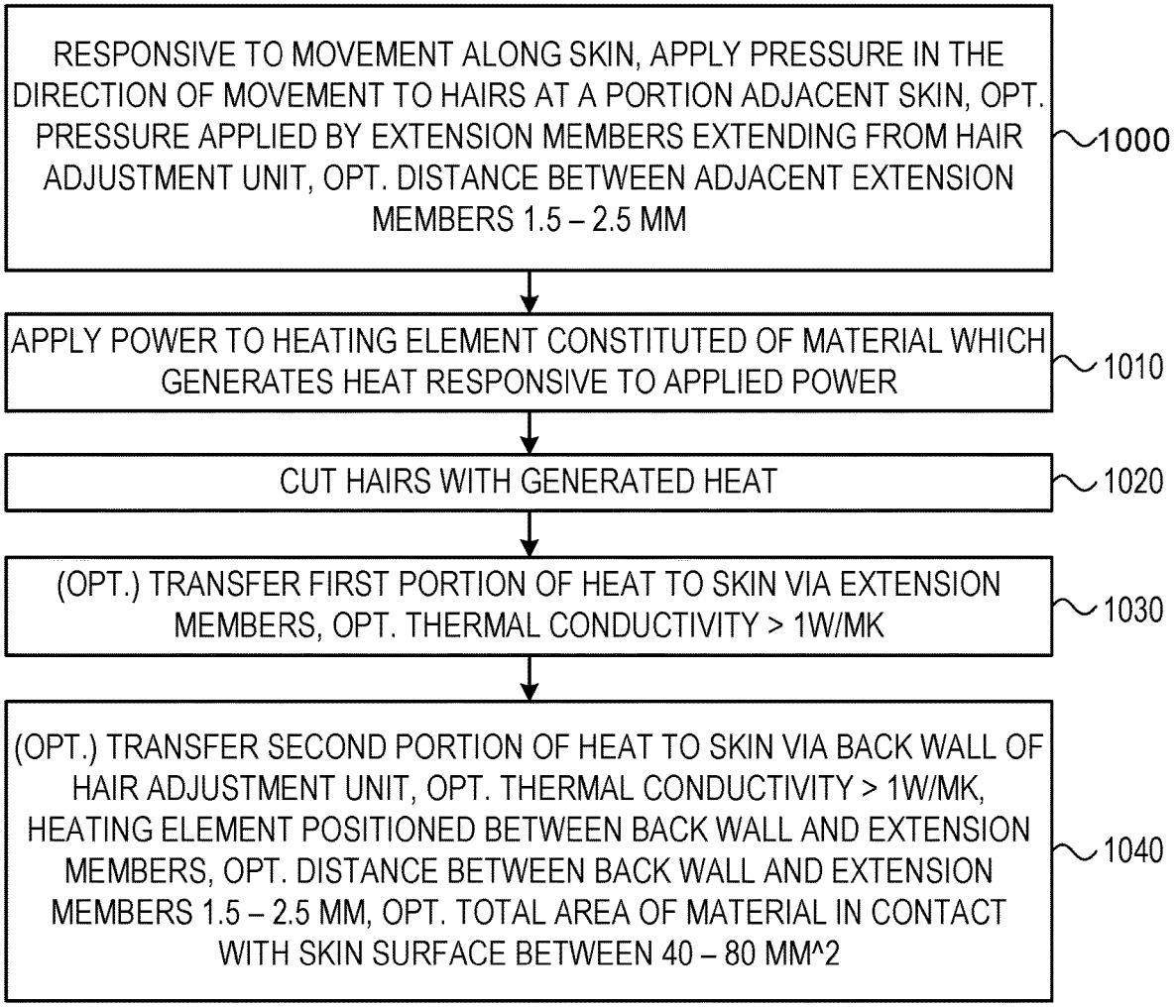
FIG. 2 illustrates a high level flow chart of a hair removal method, according to certain embodiments.

FIG. 2 illustrates a high level flow chart of a hair removal method, according to certain embodiments. In stage 1000, responsive to movement of a hair adjustment unit along a skin surface, pressure is applied to hair strands protruding from the skin surface. The pressure is applied to a portion of each of the hair strands adjacent the skin surface. Specifically, the term 'adjacent the skin surface' is meant as beginning at, or as close as possible, to the skin surface. The pressure is applied in the direction of movement of the hair adjustment unit. The applied pressure causes the hair strands to stand upright. Optionally, the pressure is applied by a plurality of extension members extending from the hair adjustment unit. In one embodiment, each extension member narrows towards a tip end thereof. In another embodiment, a first face of each extension member is generally L shaped. In one further embodiment, a second face of each extension member, opposing the first face thereof, is generally concave shaped. In one embodiment, the distance between adjacent extension members is between 1.5-2.5 mm.

In stage 1010, electric power is applied to a heating element. The heating element is constituted of a material which generates heat responsive to the applied electric power. In one embodiment, the heating element generates heat at a temperature of 400°-1900° C. In one further embodiment, the heating element generates heat at a temperature of 1000°-1900° C. In stage 1020, the hairs of stage 1000, which pressure was applied thereto, are cut with the generated heat of stage 1010. Specifically, the hairs are cut when they come in contact with the heating element.

In optional stage 1030, a first portion of the generated heat of stage 1010 is transferred to the skin surface via the optional extension members of stage 1000. Particularly, some of the heat which radiates from the heating element is conducted by the optional extension members towards the skin surface. In one embodiment, the thermal conductivity of the extension members, particularly the portions which come in contact with the skin surface, is at least 1 Watt per Meter-Kelving. In optional stage 1040, a second portion of the generated heat of stage 1010 is transferred to the skin surface via a back wall of the hair adjustment unit of stage 1000. As described above, some of the heat which radiates from the heating element is conducted by the back wall of the hair adjustment unit. The 'back' wall is defined as being displaced from the optional extension members of stage 1000 in a direction opposing the direction of movement along the skin surface. In one embodiment, the thermal conductivity of the back wall of the hair adjustment unit, particularly the portion of the back wall which comes in contact with the skin surface, is at least 1 Watt per Meter-Kelving. The heating element of stage 1010 is positioned between the back wall of the hair adjustment unit and the optional extension members of stage 1000. In one embodiment, the sum of the areas of the portions of the extension members which come in contact with the skin surface, plus the area of the portion of the back wall which comes in contact with the skin surface, is between 40-80 $mm^2$.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination. In the claims of this application and in the description of the invention, except where the context requires otherwise due to express language or necessary implication, the word "comprise" or variations such as "comprises" or "comprising" is used in any inclusive sense, i.e. to specify the presence of the stated features but not to preclude the presence or addition of further features in various embodiments of the invention.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting. No admission is made that any reference constitutes prior art. The discussion of the reference states what their author's assert, and the applicants reserve the right to challenge the accuracy and pertinency of the cited documents. It will be clearly understood that, although a number of prior art complications are referred to herein, this reference does not constitute an admission that any of these documents forms part of the common general knowledge in the art in any country.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description.

The invention claimed is:

1. A hair removal apparatus comprising:

an elongated heating element constituted of a material which generates heat responsive to electric power being applied thereto; and a hair adjustment unit, wherein said hair adjustment unit comprises:

a first elongated member generally in parallel with said elongated heating element, a second elongated member generally in parallel with said elongated heating element, and a plurality of extension members extending from said second elongated member, away from said first elongated member, said elongated heating element positioned between said first elongated member and said plurality of extension members, wherein each of said plurality of extension members exhibits a base end and a tip end, each extension member extending from said second elongated member at said base end towards said tip end, and wherein a first face of each of said plurality of extension members, at said tip ends, and a face of said first elongated member define a plane.

2. The hair removal apparatus of claim 1, wherein each of said plurality of extension members narrows towards said respective tip end.

3. The hair removal apparatus of claim 1, wherein said first face of each of said plurality of extension members is generally L shaped such that a first portion of said generally L shaped first face is generally orthogonal to said defined plane and a second portion of said generally L shaped first face extends within said defined plane, and wherein said first portion and said second portion define said general L shape.

4. The hair removal apparatus of claim 3, wherein a second face of each of said plurality of extension members, opposing said first face thereof, is generally concave shaped.

5. The hair removal apparatus of claim 1, wherein an opening is defined between said first elongated member and said plurality of extension members, said elongated heating element juxtaposed with said opening.

6. The hair removal apparatus of claim 5, wherein the distance between said first elongated member and said plurality of extension members is between 1.5-2.5 millimeters.

7. The hair removal apparatus of claim 1, wherein the distance between adjacent ones of said plurality of extension members is between 1.5-2.5 millimeters.

8. The hair removal apparatus of claim 1, further comprising a user holding device, each of said elongated heating element and said hair adjustment unit separately secured to said user holding device.

9. The hair removal apparatus of claim 1, wherein the sum of the areas of said first faces of said plurality of extension members within said plane and the area of said face of said first elongated member is between 40-80 millimeters squared.

10. The hair removal apparatus of claim 1, wherein the thermal conductivity of said first faces of said plurality of extension members within said plane and said face of said first elongated member is at least 1 Watt per Meter-Kelvin.

* * * * *